US006070659A

United States Patent [19]

Hosoya

[11] Patent Number: 6,070,659

[45] Date of Patent: Jun. 6, 2000

[54] EXTERNAL CONNECTION FOR HEAT EXCHANGER UNIT

[75] Inventor: Kazuki Hosoya, Gunma, Japan

[73] Assignee: Sanden Corporation, Gunma, Japan

[21] Appl. No.: 09/009,361

[22] Filed: Jan. 20, 1998

[30] Foreign Application Priority Data

Feb. 6, 1997 [JP] Japan ..... 9-038402

[51] Int. Cl.[7] ..... F28F 9/013

[52] U.S. Cl. ..... 165/178; 165/78; 285/124.1; 285/206

[58] Field of Search ..... 165/78, 178; 285/124.1, 285/205, 206

[56] References Cited

U.S. PATENT DOCUMENTS

| | | | |
|---|---|---|---|
| 1,981,424 | 11/1934 | Lake | 285/124.1 |
| 2,294,030 | 8/1942 | Higham et al. . | |
| 2,365,497 | 12/1944 | Smith . | |
| 2,788,991 | 4/1957 | Neuhauser | 285/124.1 X |
| 2,792,201 | 5/1957 | Whistler, Jr. . | |
| 4,172,496 | 10/1979 | Melnyk . | |
| 4,211,439 | 7/1980 | Moldestad . | |
| 4,244,194 | 1/1981 | Haesters et al. . | |
| 4,316,624 | 2/1982 | Davlin . | |
| 4,555,129 | 11/1985 | Davlin . | |
| 4,589,265 | 5/1986 | Nozawa . | |
| 4,659,116 | 4/1987 | Cameron . | |
| 4,690,209 | 9/1987 | Martin . | |
| 4,914,929 | 4/1990 | Shimazaki | 62/515 |
| 4,940,263 | 7/1990 | Mayernik . | |
| 4,957,158 | 9/1990 | Ando . | |
| 5,060,988 | 10/1991 | Williamson . | |
| 5,066,051 | 11/1991 | Weigl et al. . | |
| 5,095,972 | 3/1992 | Nakaguro . | |
| 5,105,877 | 4/1992 | Ando . | |
| 5,205,520 | 4/1993 | Walker | 285/124.1 X |
| 5,209,290 | 5/1993 | Chigira . | |
| 5,307,038 | 4/1994 | Ishimaru . | |
| 5,419,042 | 5/1995 | Kado . | |
| 5,526,876 | 6/1996 | Karube . | |
| 5,697,546 | 12/1997 | Cicioni | 165/178 |
| 5,853,201 | 12/1998 | Izumi et al. | 285/205 X |

FOREIGN PATENT DOCUMENTS

| | | |
|---|---|---|
| 683479 | 11/1995 | European Pat. Off. . |
| 693667 | 1/1996 | European Pat. Off. . |
| 2309023 | 11/1976 | France . |
| 1035250 | 4/1995 | France . |
| 1287692 | 1/1969 | Germany . |
| 59-210300 | 11/1984 | Japan . |
| 116817 | 5/1946 | Sweden . |
| 2078361 | 1/1982 | United Kingdom . |

OTHER PUBLICATIONS

Author Unknown, "Block Assembly—Inlet and Outlet Tubes on Heat Exchangers", Date Unknown.

*Primary Examiner*—Leonard Leo
*Attorney, Agent, or Firm*—Baker Botts L.L.P.

[57] ABSTRACT

A heat exchanger unit has a case made of plastic or resin, and a heat exchanger is accommodated and fixed within the case. Within the case, first terminal ends of the inlet pipe and outlet pipe are connected to the heat exchanger, and second terminal ends of the pipes are fixed to a wall on the case by the external pipe connection portion. The external pipe connection portion has a flange portion formed integrally with the case itself on the wall, and a nut plate.

8 Claims, 9 Drawing Sheets

EXTERNAL CONNECTION FOR HEAT EXCHANGER UNIT

BACKGROUND OF THE INVENTION

1. Field of the Invention

The present invention relates to a heat exchanger unit for use in an automotive air conditioning system and, more particularly, to a heat exchanger unit having an improved external pipe connection.

2. Description of Related Art

A known heat exchanger unit 70 is depicted in FIG. 1. Heat exchanger 70 comprises a case 71 and a heat exchanger 72. Case 71 comprises an upper case member 73 and a lower case member 74 made of plastic or resin. Within case 71, heat exchanger 72 is accommodated and fixed. An inlet pipe 75 and an outlet pipe 76 for refrigerant are connected to heat exchanger 72. The open ends of both pipes are fixed to a flange member 77. Flange member 77 is sandwiched by receptor portion 78 provided on the lower periphery of upper case member 73 and receptor portion 79 provided on the upper periphery of the lower case member 74, and fixed therebetween. Flange member 77 is the external pipe connection portion that is the focus of the present invention.

In FIG. 2, heat exchanger 72 is depicted before being accommodated into case 71. Here, flange member 77, inlet pipe 75, and outlet pipe 76 have to be fixed to each other by pipe expanding, before heat exchanger 72 is accommodated into case 71. In FIGS. 3. through 5, the pipe expanding process is shown. FIG. 3 illustrates flange member 77 and outlet pipe 76 before pipe expanding. FIG. 4 illustrates the condition of outlet pipe 76 during pipe expanding, i.e., a core bar 100 is inserted into outlet pipe 76. FIG. 5 illustrates the condition of outlet pipe 76 after the pipe expanding. Generally, it is required to control the diameter of the external pipe connection portion with a high degree of precision in order to prevent refrigerant leakage. That is, with reference to FIG. 5, the precision of the diameter d' after the pipe expanding must be within a tolerance of plus minus 0.02 mm. This requirement of a high degree of precision of the diameter after pipe expanding necessitates a high degree of precision before pipe expanding too. In particular, with reference to FIG. 3, the diameter of an inner peripheral surface 77*s* of flange member 77 also must be within the tolerance limit of plus minus 0.02 mm. To establish and maintain such a relatively high degree of precision in shaping inner peripheral surface 77*s* of flange member 77, a conforming tool is required, which is expensive. In addition, because flange member 77 is formed of a relatively large block of aluminum, it requires a significant amount of material to manufacture. This factor also increases the manufacturing cost of the heat exchanger unit as a whole.

In the field of automotive air conditioning systems, there is a strong desire to keep cost down. As explained above, the external pipe connection part of a known heat exchanger structure, that is flange member 77 has been an obstacle to further cost reductions in manufacturing heat exchanger unit 70. Thus, for further cost reductions, it has been long desired to improve the structure of the external pipe connection portion of heat exchanger unit 70.

SUMMARY OF THE INVENTION

Accordingly, it is an object of the present invention to provide a heat exchanger unit with an improved external pipe connection portion, which enables the cost of manufacturing to be reduced. The heat exchanger unit comprises a case and a heat exchanger having an inlet pipe and an outlet pipe, terminal ends of which are fixed to an external pipe connection portion on a wall of the case. The external pipe connection portion of the heat exchanger unit according to the present invention comprises a flange portion, which may be formed integrally with the case, and a female screw member, such as a nut plate, accommodated within a groove provided in the flange portion. Because an expensive flange member, which is made of massive aluminum block and requires high precision processing, is no longer necessary, it is possible to reduce the manufacturing cost of the heat exchanger unit.

Other objects, features, and advantages of this invention will be understood from the following detailed description of preferred embodiments with reference to the drawings.

DETAILED DESCRIPTION OF PREFERRED EMBODIMENTS

Figure 1:
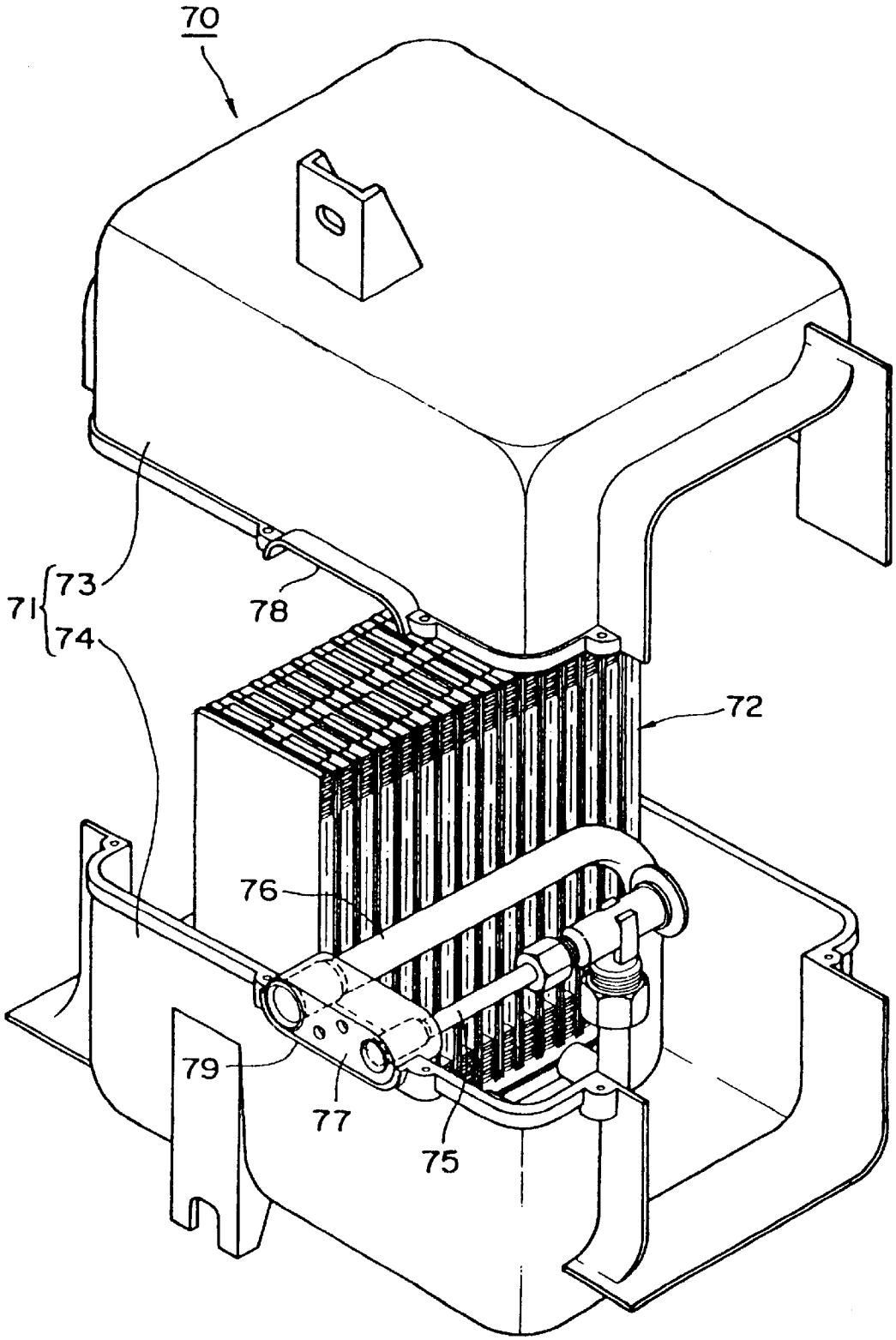
Fig. 1 ( Prior Art )
FIG. 1 is an expanded, perspective view of a heat exchanger unit according to a known design.
Figure 2:
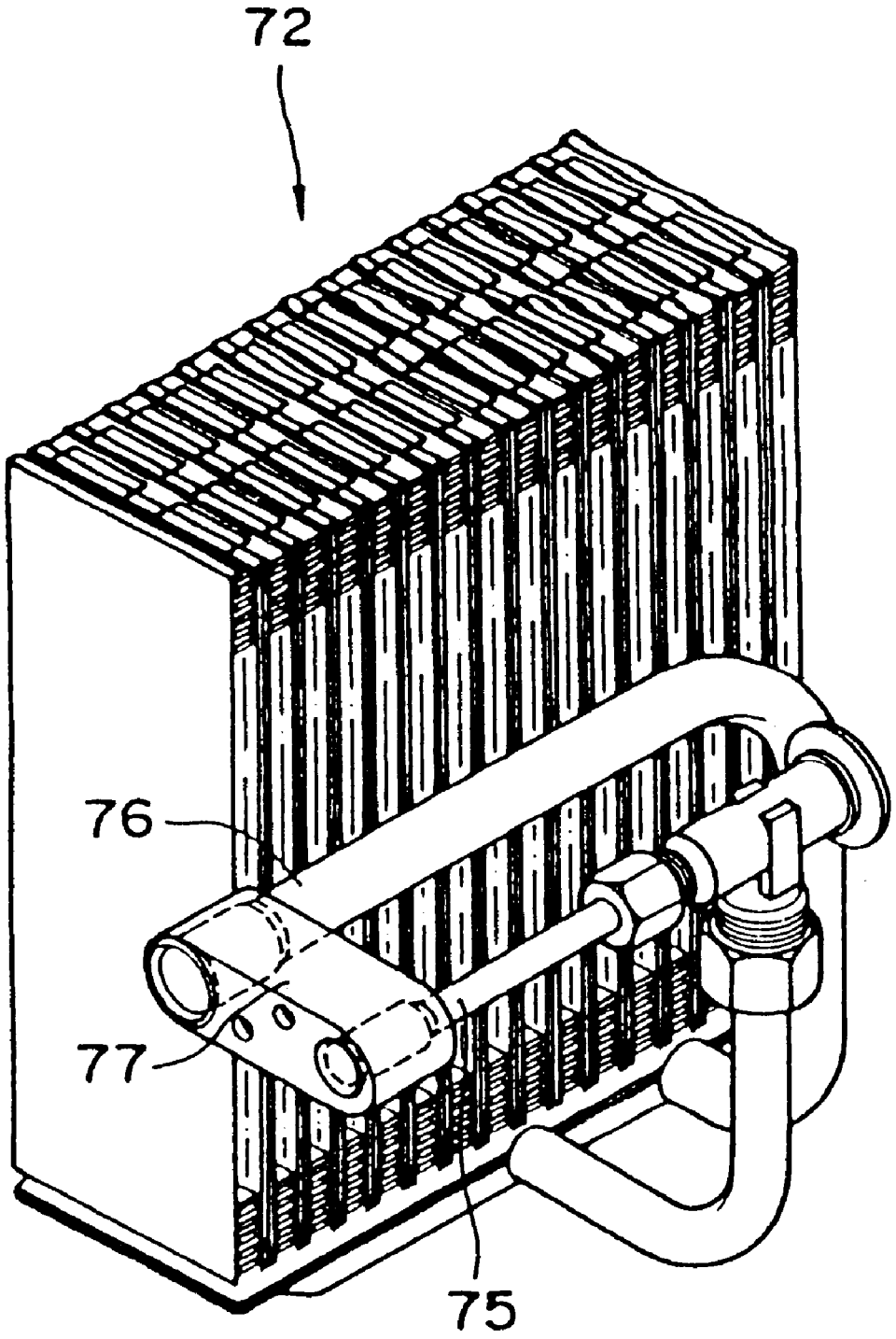
Fig. 2 (Prior Art)
FIG. 2 is a perspective view of a heat exchanger equipped with the flange member according to a known design.
Figure 3:
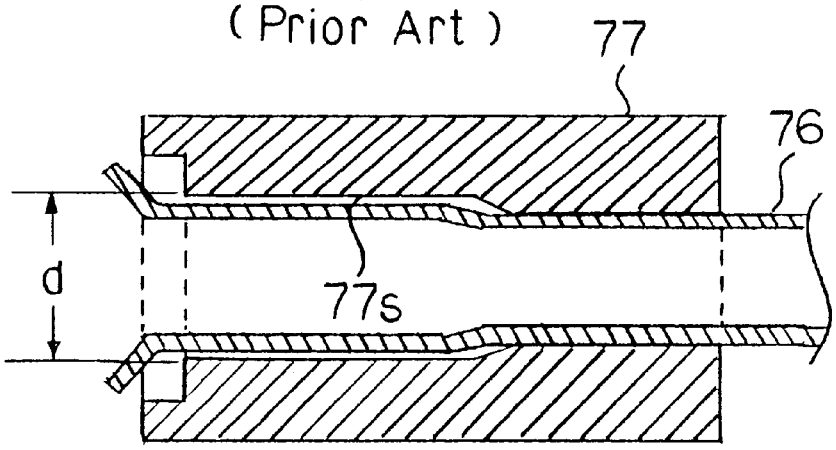
Fig. 3 (Prior Art)
FIG. 3 is a cross-sectional view of the flange member before the pipe expanding.
Figure 4:
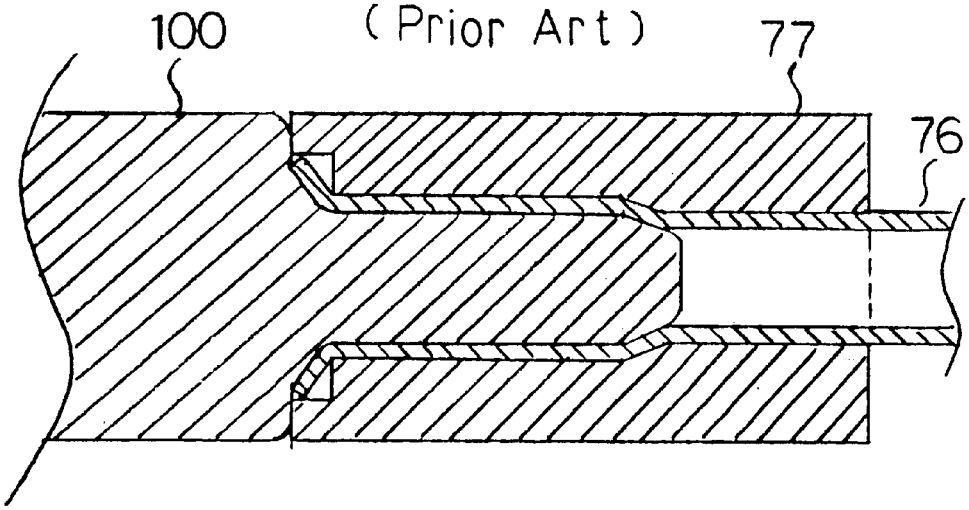
Fig. 4 (Prior Art)
FIG. 4 is a cross-sectional view of the flange member during the pipe expanding.
Figure 5:
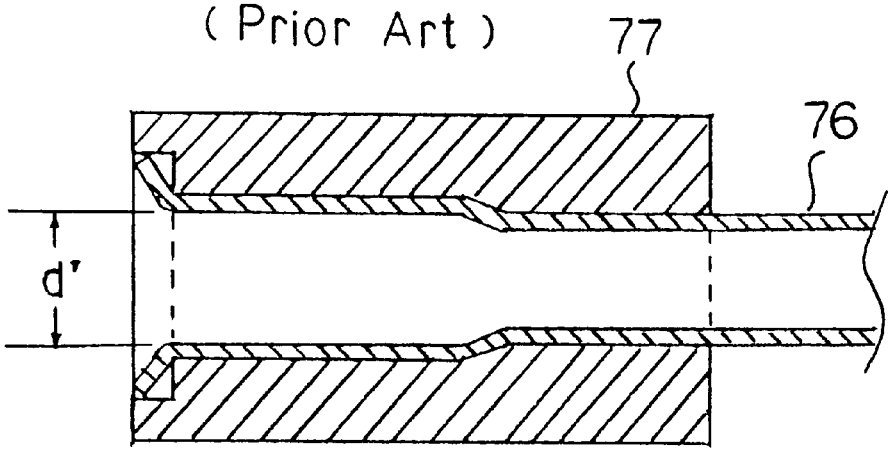
Fig. 5 (Prior Art)
FIG. 5 is a cross-sectional view of the flange member after the pipe expanding.
Figure 6:
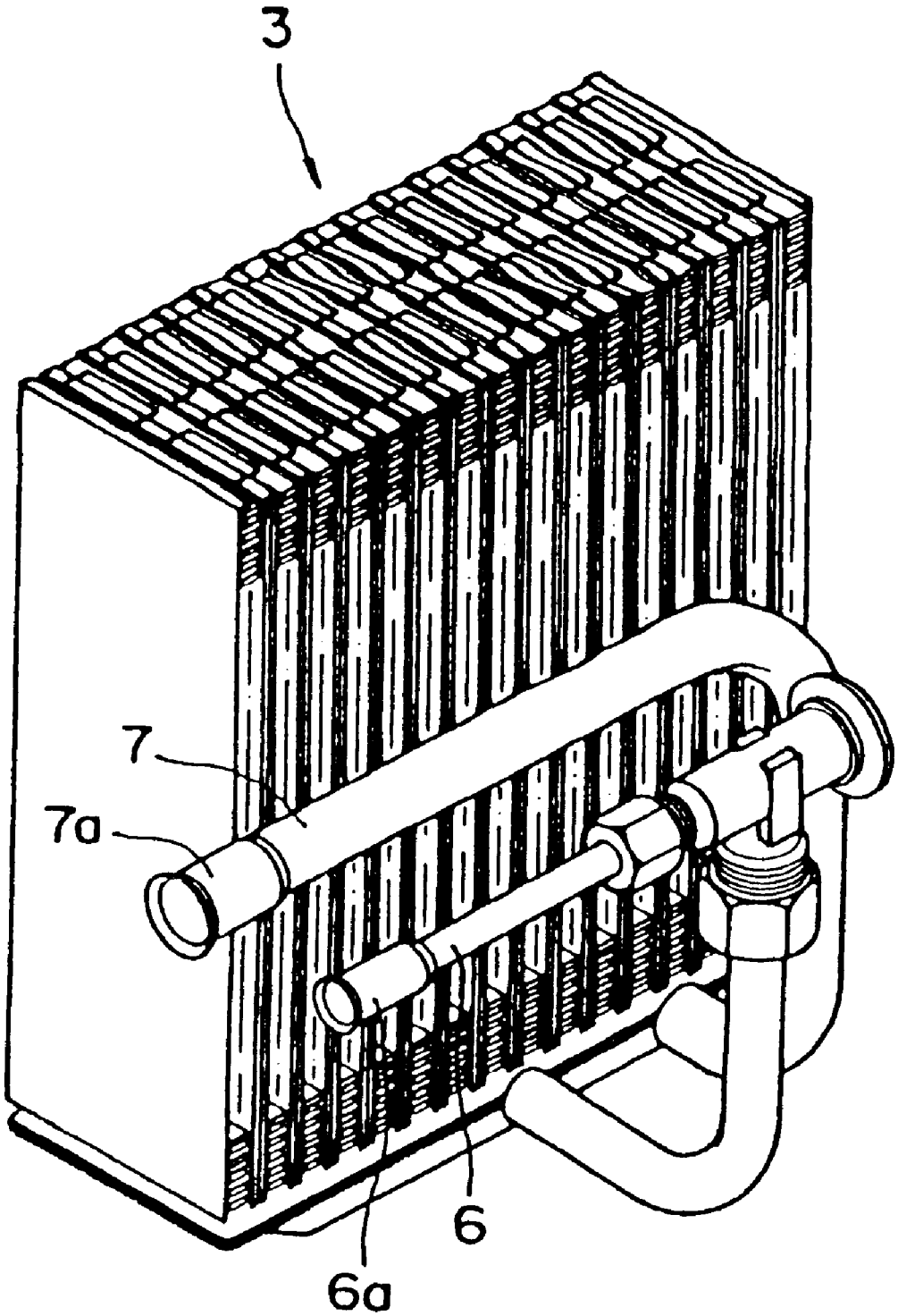
FIG. 6 is a perspective view of a heat exchanger according to the present invention.

With reference to FIGS. 6–10, an embodiment of the present invention is now described. In FIG. 6, a heat exchanger 3 is depicted before being accommodated and fixed within a case (not shown). An inlet pipe 6 and an outlet pipe 7 are connected to heat exchanger 3. A first terminal 5 end 6*a* of the inlet pipe 6 is formed to have two conical portions. Further, a first terminal end 7*a* of the outlet pipe 7 is formed to have two conical portions. Comparing FIG. 6 with FIG. 2, heat exchanger 3 of the present invention lacks flange member 77 of heat exchanger unit 70.

Figure 7:
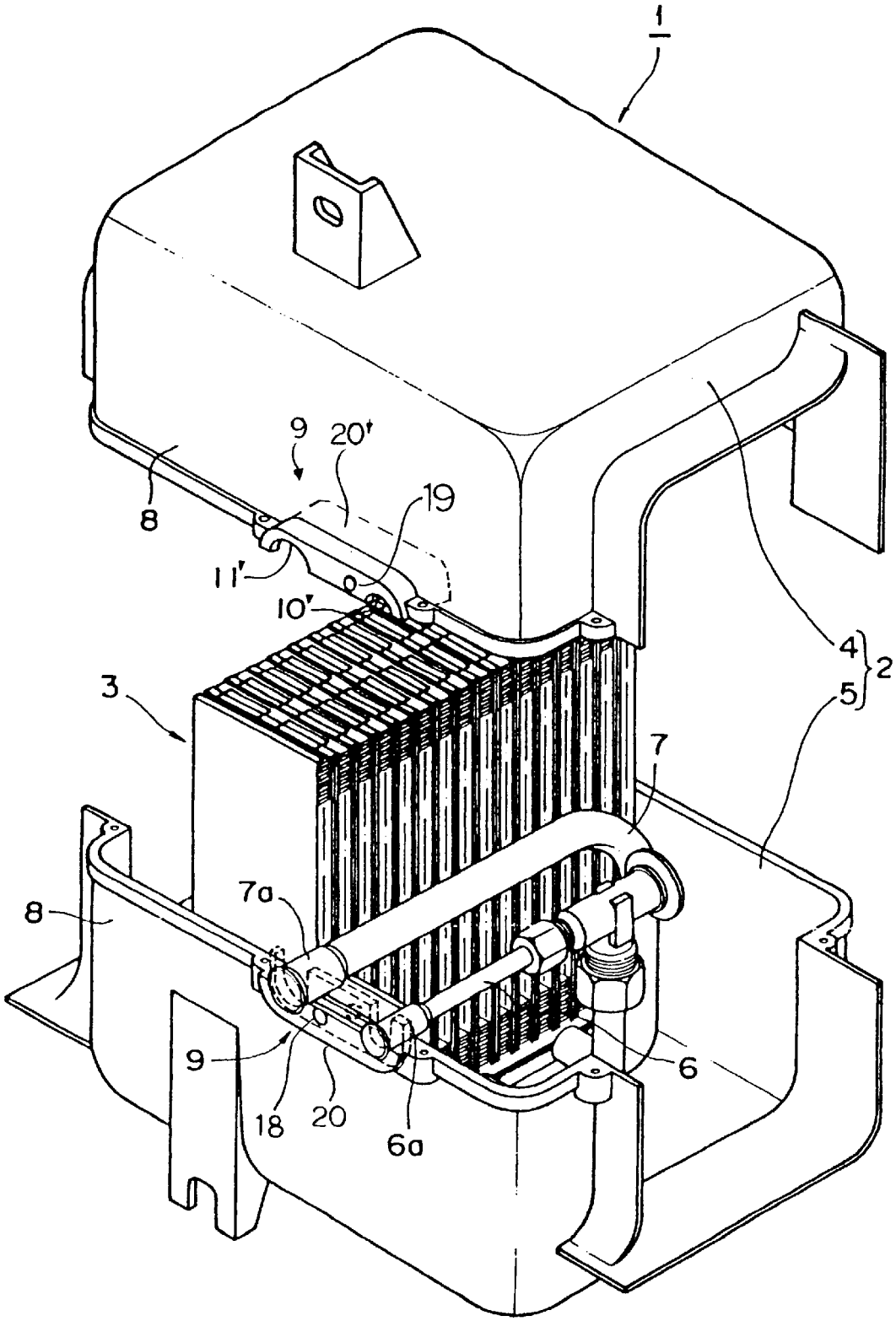
FIG. 7 is an expanded perspective view of a heat exchanger unit according to the present invention.

In FIG. 7, the structure of heat exchanger unit 1 according to an embodiment of the present invention is depicted. Heat exchanger unit 1 comprises a case 2 made of plastic or resin and heat exchanger 3. Case 2 comprises an upper case member 4 and lower case member 5. An external pipe connection portion 9 includes upper flange portion 20' and lower flange portion 20, and a nut plate (not shown) which is described below. First terminal end 6*a* of inlet pipe 6 and first terminal end 7*a* of outlet pipe 7 are fixed directly to case 2 by external pipe connection portion 9 on wall 8. Hemicylindrical recesses 10' and 11' provided in upper flange portion 20' accommodate the upper halves of first terminal ends 6*a* and 7*a* of inlet pipe 6 and outlet pipe 7, respectively.

On the periphery of upper case member 4, upper flange portion 20' is formed integrally with upper case member 4 itself. In upper flange portion 20', a hole 19 is provided to receive a bolt (not shown) therethrough. On the periphery of lower case member 5, lower flange portion 20 is formed integrally with lower case member 5 itself. In lower flange portion 20, a hole 18 is provided to receive a bolt (not shown) therethrough.

Figure 8:
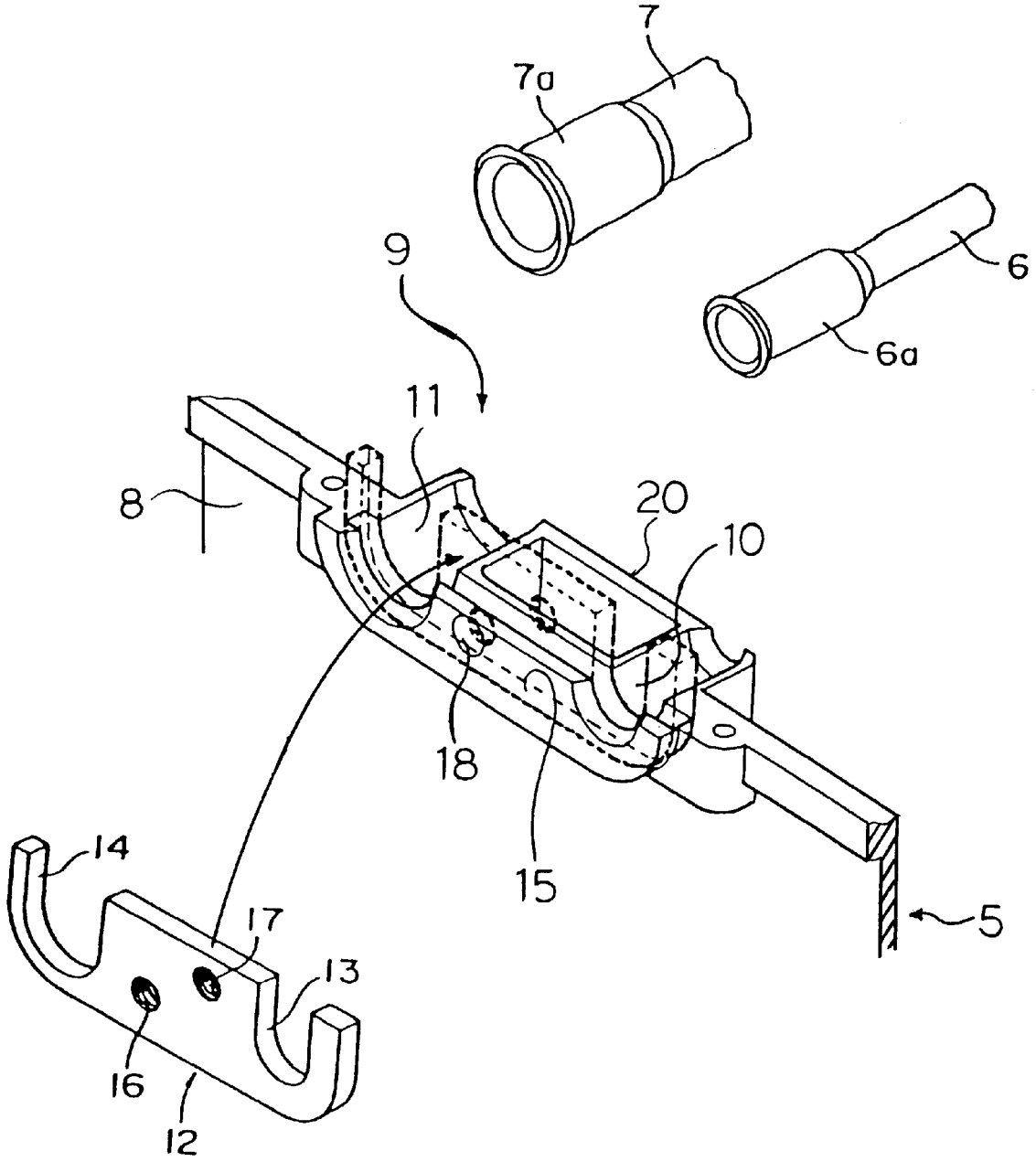
FIG. 8 is a detailed, expanded perspective view of the external pipe connection portion of the heat exchanger unit according to the present invention.

In FIG. 8, a detailed structure of external pipe connection portion 9 on wall 8 of heat exchanger unit 1 is shown. Hemicylindrical recesses 10 and 11 provided in lower flange portion 20 accommodate the lower halves of first terminal ends 6*a* and 7*a* of inlet pipe 6 and outlet pipe 7, respectively. A nut plate 12 is accommodated in a groove 15 which is provided within lower flange portion 20. In nut plate 12, there are provided two U-shaped recesses 13 and 14 to permit first terminal ends 6*a* and 7*a* of inlet and outlet pipes 6 arid 7, respectively, to pass therethrough. In addition, in nut plate 12, there are provided two female screws 16 and 17 for fixing an external connector 30 depicted in FIG. 9.

Figure 9:
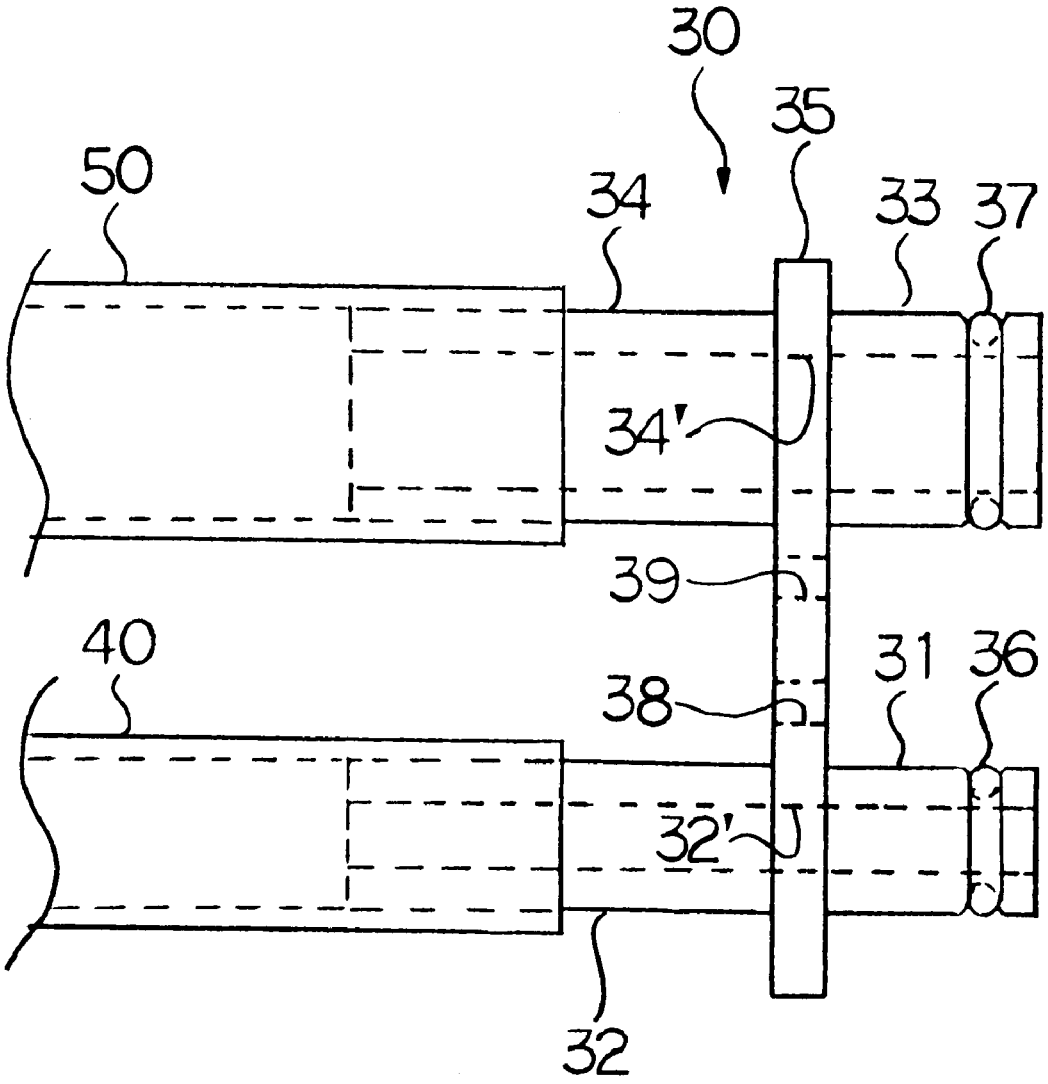
FIG. 9 is a top plan view of an external connector connected to the external pipe connection portion of the heat exchanger unit according to the present invention.

With reference to FIG. 9, on both sides of a plate 35 of external connector 30 short pipes 31, 32, 33, and 34 are attached. Plate 35 is penetrated by two holes 32' and 34' so as to enable the passage from short pipe 32 to short pipe 31, and from short pipe 34 to short pipe 33, respectfully. Short pipes 31 and 33 are inserted into first terminal ends 6*a* and 7*a* secured in external pipe connection portion 9 of heat exchanger 3 of the present invention. O-rings 36 and 37 are equipped on short pipes 31 and 33, respectively, for sealing. An inlet hose 40 and an outlet hose 50 are connected to short pipes 32 and 34 on the opposite side of plate 35. Two holes 38 and 39 adapted to pass bolts through are provided at about the central portion of plate 35.

Figure 10:
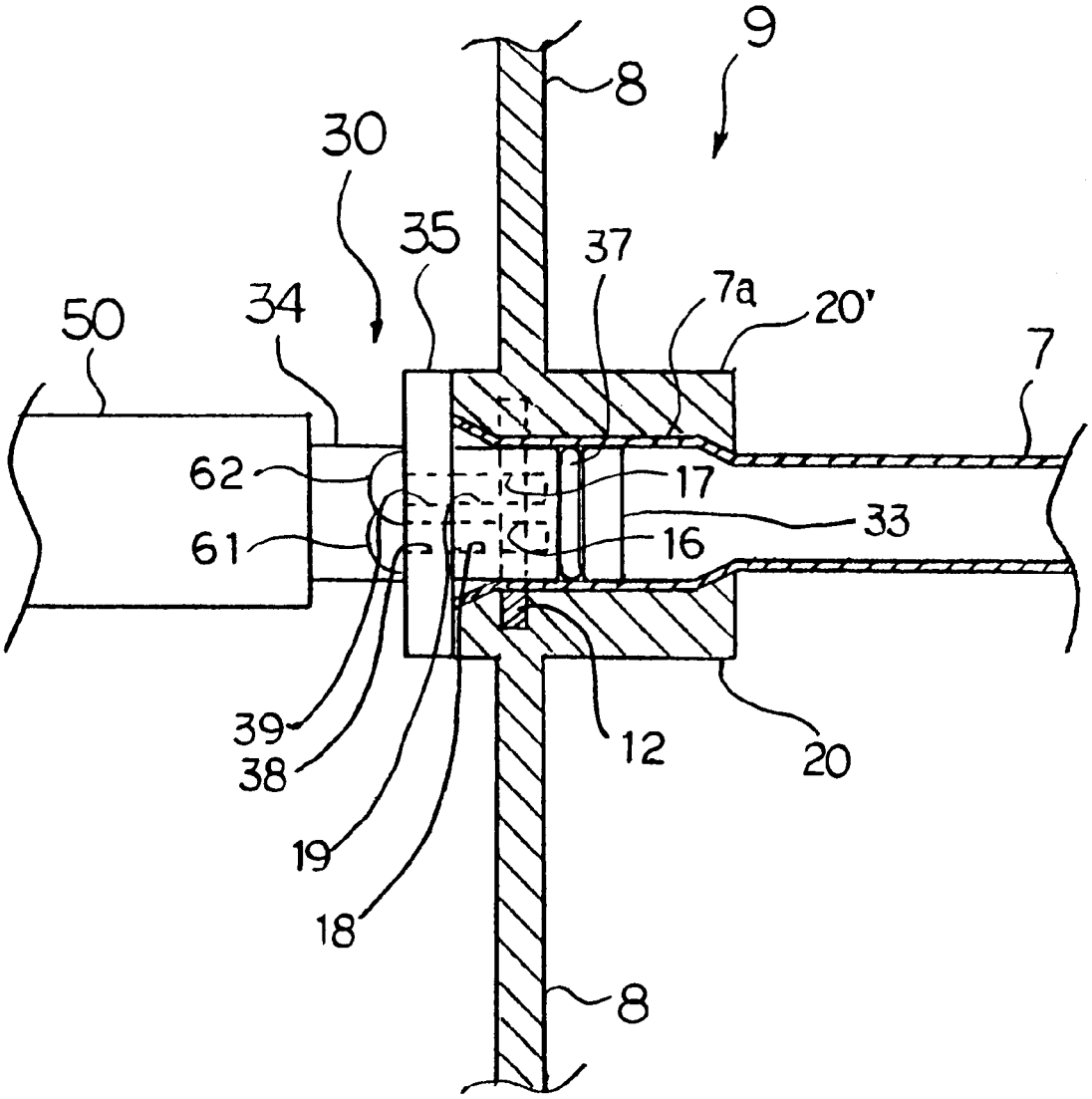
FIG. 10 is a partial cross-sectional view of the external connection portion to which an external connector is connected and fixed.

In FIG. 10, external connector 30 is shown connected and fixed to external pipe connection portion 9. Short pipe 33 of external connector 30 is inserted into first terminal end 7*a* of outlet pipe 7. O-ring 37 functions to seal and prevent the refrigerant leakage in this portion. Two bolts 61 and 62 are screwed on female threaded screws 16 and 17 in nut plate 12. Bolts 61 and 62 also pass through holes 38 and 39 and holes 18 and 19 in external pipe connection portion 9.

Figure 11:
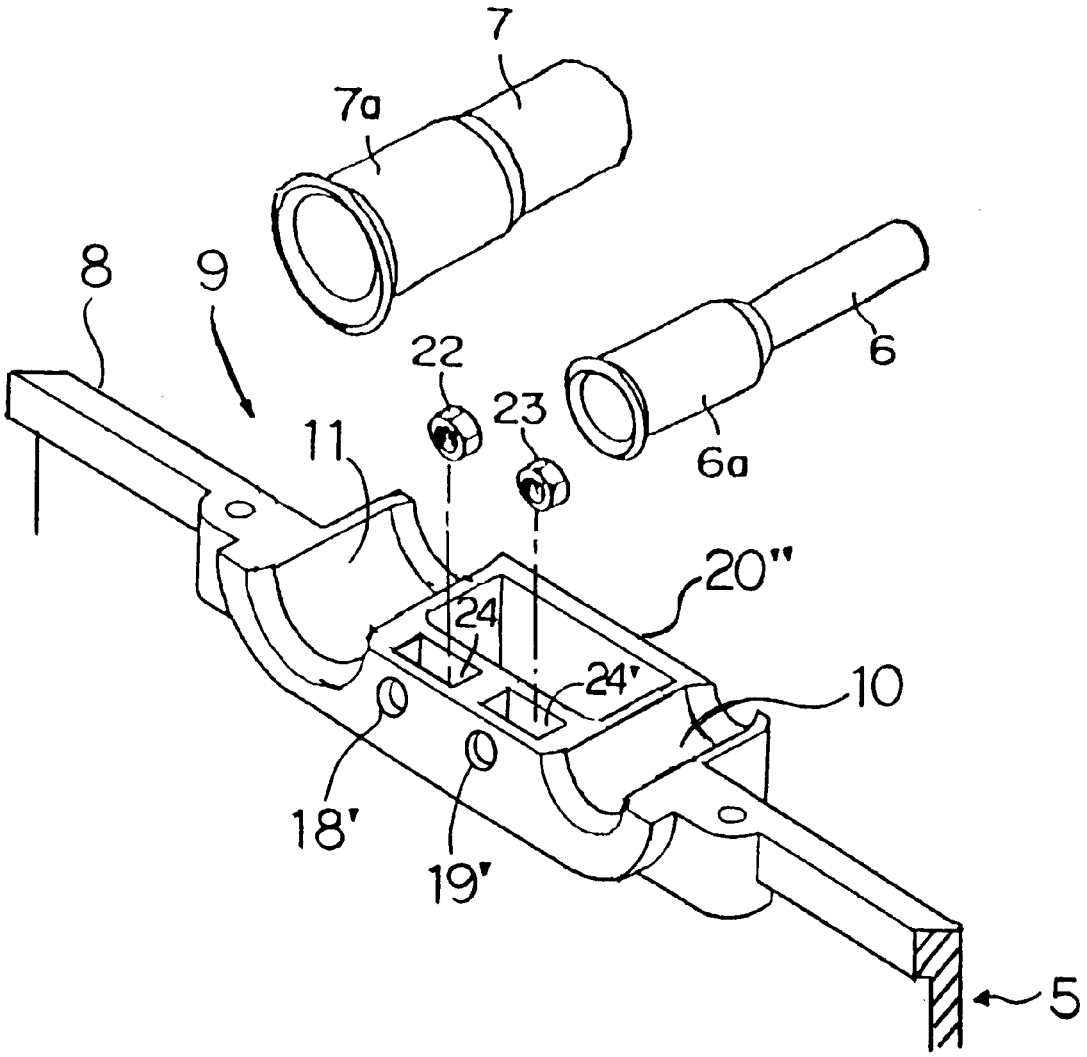
FIG. 11 is a detailed, expanded perspective view of another embodiment of the present invention.

In FIG. 11, another embodiment of the present invention is illustrated. Flange portion 20" has pockets 24 and 24' to accommodate individual nuts 22 and 23. Holes 18' and 19' receive bolts (not shown) through which external connector 30 is fixed. Other details of the structure and the state of connection between external connector 30 and external pipe connection portion 9 are substantially the same as described above.

Thus, the heat exchanger unit according to the present invention has on its case wall an external pipe connection portion, and this external pipe connection portion has a flange portion which is formed integrally with the case, and which fixes the first terminal ends of the inlet pipe and outlet pipe. The external connector may be fixed by the nut plate provided in a groove in the flange portion or individual nuts provided in the pockets in the flange portion. As a result, the known expensive flange member, which required high precision processing and a large amount of material, becomes unnecessary. Therefore, it becomes possible to attain an effective cost reduction in the manufacturing the heat exchanger unit.

This invention has been described in detail in connection with preferred embodiments. These embodiments, however, are only exemplary, and the invention is not restricted thereto. It will be understood by those skilled in the art that variations and modifications may be made within the scope of this invention, as defined by the appended claims.

What is claimed is:

1. A heat exchanger unit comprising:

a case;

a heat exchanger having an inlet pipe and an outlet pipe;

an external pipe connection portion formed on a wall of said case, said external pipe connection portion comprising:

a flange portion formed integrally with said case;

a first and second recess each for receiving a terminal end of said inlet pipe and said outlet pipe; and a female screw member accommodated in said flange portion;

wherein said terminal ends of said inlet pipe and said outlet pipe are adapted to receive connecting pipes from an external connector.

2. The heat exchanger unit of claim 1, wherein said female screw member is a nut plate which has U-shaped recesses to receive said terminal ends of said inlet pipe and said outlet pipe therethrough, and a plurality of female screws.

3. The heat exchanger unit of claim 1, wherein said female screw member is comprised of a plurality of individual nuts.

4. The heat exchanger unit of claim 1, wherein said case is manufactured from a material selected from the group consisting of plastic and resin.

5. The heat exchanger unit of claim 2, wherein said case is manufactured from a material selected from the group consisting of plastic and resin.

6. The heat exchanger unit of claim 3, wherein said case is manufactured from a material selected from the group consisting of plastic and resin.

7. The heat exchanger of claim 1, wherein said external connector comprises:

a side plate, said side plate having two holes;

a first pair of short pipes attached on opposite sides of said side plate, wherein said first pair of short pipes communicate through one of said holes; and a second pair of short pipes attached on opposite sides of said side plate, wherein said second pair of short pipes communicate through the other of said holes;

wherein said external connector fluidly connects an inlet hose to said terminal end of said inlet pipe, and an outlet hose to said terminal end of said outlet pipe.

8. The heat exchanger of claim 7, further comprising:

at least one o-ring on at least one of said pairs of short pipes.

* * * * *